US005480320A

United States Patent [19]

Saimoto

[11] Patent Number: 5,480,320

[45] Date of Patent: Jan. 2, 1996

[54] ELECTRICAL CONNECTION ELEMENT

[75] Inventor: Tetsuro Saimoto, Shizuoka, Japan

[73] Assignee: Yazaki Corporation, Tokyo, Japan

[21] Appl. No.: 304,708

[22] Filed: Sep. 12, 1994

[30] Foreign Application Priority Data

Sep. 14, 1993 [JP] Japan ..... 5-251005

[51] Int. Cl.[6] ..... H01R 11/22

[52] U.S. Cl. ..... 439/852; 439/839; 439/474

[58] Field of Search ..... 439/839, 851–852, 439/856–857, 668, 474

[56] References Cited

U.S. PATENT DOCUMENTS

| | | | |
|---|---|---|---|
| 4,493,526 | 1/1985 | Masuda | 339/183 |
| 4,560,231 | 12/1985 | Shirai | 339/258 |
| 4,909,762 | 3/1990 | Yagi et al. | 439/852 |
| 5,271,741 | 12/1993 | Saito et al. | 439/843 |
| 5,360,356 | 11/1994 | May et al. | 439/851 |

FOREIGN PATENT DOCUMENTS

| | | |
|---|---|---|
| 55-14230 | 1/1980 | Japan . |
| 55-36528 | 3/1980 | Japan . |
| 58-62564 | 4/1983 | Japan . |
| 63-73869 | 5/1988 | Japan . |
| 115174 | 8/1989 | Japan . |
| 1168969 | 11/1989 | Japan . |
| 298478 | 8/1990 | Japan . |

*Primary Examiner*—David L. Pirlot
*Assistant Examiner*—Jill DeMello
*Attorney, Agent, or Firm*—Sughrue, Mion, Zinn, Macpeak & Seas

[57] ABSTRACT

An electrical connection element is of an integral construction formed by blanking and bending (i.e., metal sheet working) a single metal base plate. More specifically, the electrical connection element includes a clamping portion formed at one longitudinal end for compressively clamping an end portion of a connection wire, a resilient connecting portion formed at the other end portion by folding the metal base plate twice, an outer wall portion surrounding the resilient connecting portion, and a pair of flexure prevention pieces which are formed on the metal base plate, and are provided respectively at opposite side walls **14*a* and 14*b*** of the outer wall portion. A distal end of each of the flexure prevention pieces is slanting at an angle corresponding to the angle of inclination of the resilient connecting portion deformed to a predetermined degree. For connecting a male terminal, it is inserted in a predetermined direction, so that the resilient connecting portion is resiliently deformed to be brought into face-to-face contact with the slanting distal ends of the flexure prevention pieces. Therefore, even if an excessive external force is applied, the resilient connecting portion will not be plastically deformed by the corners of the distal ends of the flexure prevention pieces.

7 Claims, 6 Drawing Sheets

ELECTRICAL CONNECTION ELEMENT

BACKGROUND OF THE INVENTION

1. Field of the invention

This invention relates to an electrical connection element used as a connection terminal in a connector for making an electrical connection to electrical equipment or in a junction connector, and more particularly to an electrical connection element which is prevented from plastic deformation due to interference with a mating terminal with which it is electrically connected, and can provide a good contact load.

2. Related art

A conventional electrical connection element of the common type will now be described with reference to FIGS. 8 to 10. As shown in FIG. 8, the electrical connection element 1 is one called a female terminal, and includes a longitudinal outer wall portion 2, a resilient connecting portion 4 formed by folding back a metal base plate 3, and a pair of flexure prevention pieces 5*a* and 5*b*. These constituent elements are formed integrally by working the single metal base plate 3.

As shown in FIG. 9, the resilient connecting portion 4 is slanting upwardly as viewed from a direction A of insertion of a male terminal 6, and when the male terminal 6 is inserted, the connecting portion 4 is deformed downwardly as shown in FIG. 10. However, since first and second folded portions 7*a* and 7*b* are so folded as to be resiliently deformable, the male terminal 6 can be inserted with a low resistance, and the resilient connecting portion 4 resiliently contacts the male terminal 6 over a wide area, thus making a good electrical connection.

When the resilient connecting portion 4 is deformed as shown in FIG. 10, the flexure prevention pieces 5*a* and 5*b* engage the back side of the resilient connecting portion 4 to limit the deformation, thus preventing plastic deformation. To achieve this, the flexure prevention pieces 5*a* and 5*b* are stamped out to project inwardly respectively from opposite side walls 2*a* and 2*b* of the outer wall portion 2, and are extended into the resilient connecting portion 4 in perpendicular relation to the opposite side walls 2*a* and 2*b*.

Incidentally, the connection construction of the above electrical connection element is disclosed in Japanese Utility Model Unexamined Publication Nos. 55-14230, 55-36528, 58-62564, 1-115174 and 1-168969.

The outer wall portion 2 is formed by bending after the resilient connecting portion 4 is formed by the metal base plate 3. If the flexure prevention pieces 5*a* and 5*b*, formed respectively on the opposite side walls 2*a* and 2*b*, are made long, these pieces interfere with the bending of the outer wall portion 2, and therefore they can not be made long. For this reason, in the assembled condition shown in FIG. 8, the flexure prevention pieces 5*a* and 5*b* can not be sufficiently extended in facing relation to the back side of the resilient connecting portion 4. Therefore, when the resilient connecting portion 4 is flexed and deformed as shown in FIG. 10, part of the resilient connecting portion 4, that is, opposite side portions of the resilient connecting portion 4, engage the flexure prevention pieces 5*a* and 5*b*, respectively, and therefore the amount of flexing of the resilient connecting portion 4 has been liable to vary.

The flexure prevention pieces 5*a* and 5*b* must be formed short because of the above-mentioned working limitation; however, it is difficult to obtain satisfactory dimensional accuracies of such stamped-out portions. Further, the dimensions of the flexure prevention pieces 5*a* and 5*b* are also influenced by the accuracy of bending of the outer wall portion 2, and therefore the opposite side walls 2*a* and 2*b* must be parallel to each other.

As described above, in the above conventional electrical connection element 1, because of the workability of the flexure prevention pieces, such as their length, and also because of an insufficient face-to-face contact of the resilient connecting portion with the flexure prevention pieces, there has been encountered a problem that a stable flexure prevention function and others can not be achieved.

SUMMARY OF THE INVENTION

With the above problems in view, it is an object of this invention to provide an electrical connection element in which a plastic deformation of a resilient connecting portion is positively prevented, thereby uniformly limiting the flexing of this resilient connecting portion, and the workability is excellent.

The above object has been achieved by an electrical connection element wherein a mating male terminal is adapted to resiliently contact a resilient connecting portion formed by resiliently deformably folding a metal base plate; characterized in that flexure prevention pieces for preventing an excessive deformation upon contact of the male terminal are provided so as to be brought into face-to-face contact with a back side of the resilient connecting portion when the resilient connecting portion is deformed to a predetermined degree.

The above object has also been achieved by a construction in which the flexure prevention pieces are projectingly formed respectively at those portions of the metal base plate facing the back side of the resilient connecting portion, and a distal end of each of the flexure prevention pieces is slanting at an angle corresponding to the angle of inclination of the resilient connecting portion deformed to the predetermined degree.

The above object has also been achieved by a construction in which the flexure prevention pieces are formed by stamping or blanking side portions of the metal base plate and then by raising these portions, and a distal end portion of the resilient connecting portion, folded back in facing relation to the back side thereof, is tapering to avoid the flexure prevention pieces.

In the electrical connection element of the present invention, the flexure prevention pieces for preventing an excessive deformation upon contact of the male terminal are provided so as to be brought into face-to-face contact with the back side of the resilient connecting portion when the resilient connecting portion is deformed to a predetermined degree. Therefore, when the resilient connecting portion is resiliently deformed to engage the flexure prevention pieces upon deformation of the resilient connecting portion to the predetermined degree or except for that time, the resilient connecting portion will not be plastically deformed by the end edges of the flexure prevention pieces, so that the flexing of the resilient connecting portion can be positively limited uniformly.

Furthermore, the flexure prevention pieces are formed by stamping or blanking the side portions of the metal base plate and then by raising these portions, and the distal end of each flexure prevention piece is slanting at an angle corresponding to the angle of inclination of the resilient connecting portion deformed to the predetermined degree. Therefore, an enhanced bending precision can be obtained more easily, and an excellent workability is obtained.

DETAILED DESCRIPTION OF THE PREFERRED EMBODIMENTS

One preferred embodiment of an electrical connection element of the present invention will now be described with reference to FIGS. 1 to 5.

Figure 1:
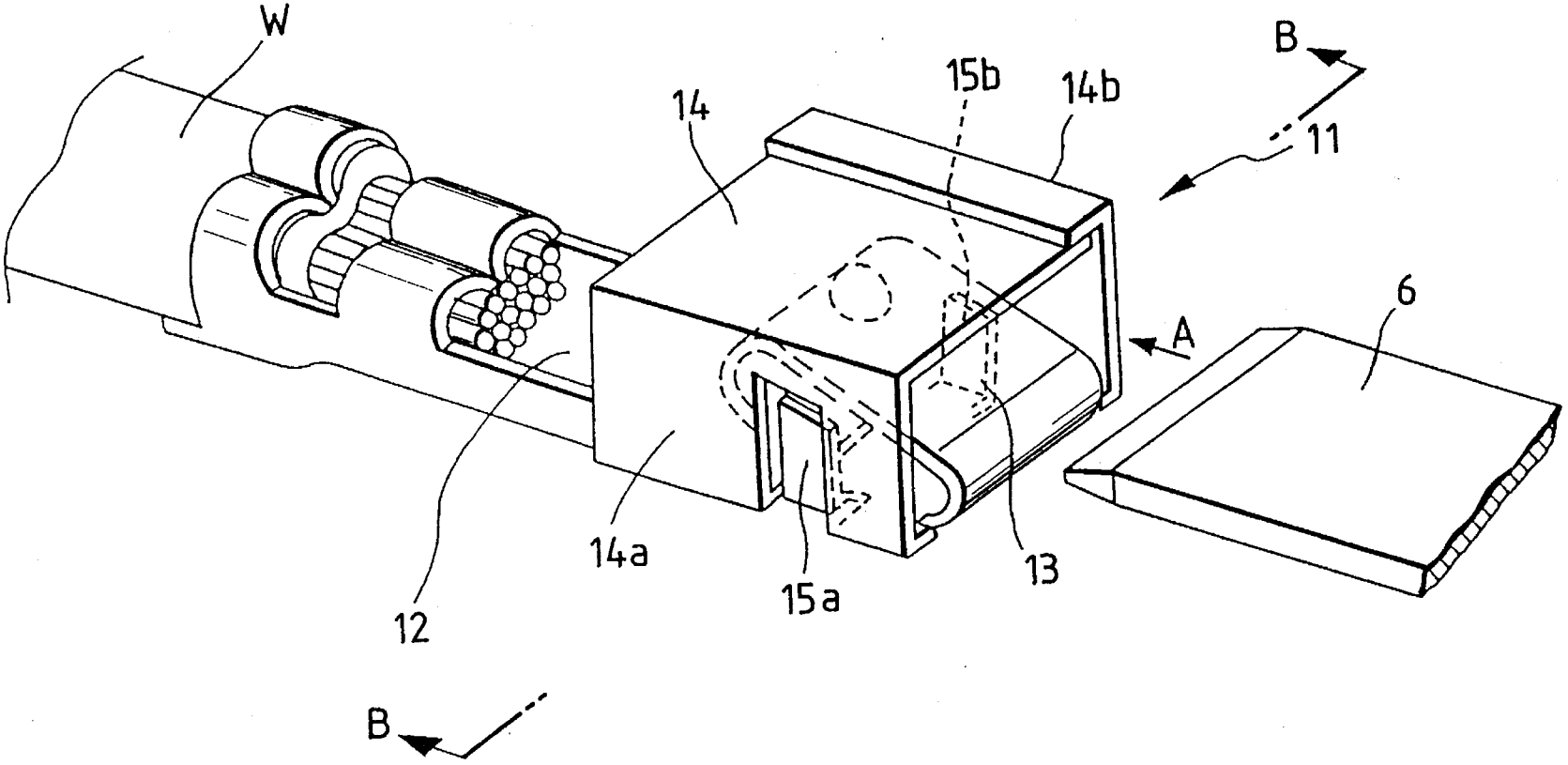
FIG. 1 is a perspective view of one preferred embodiment of an electrical connection element of the present invention.
Figure 2:
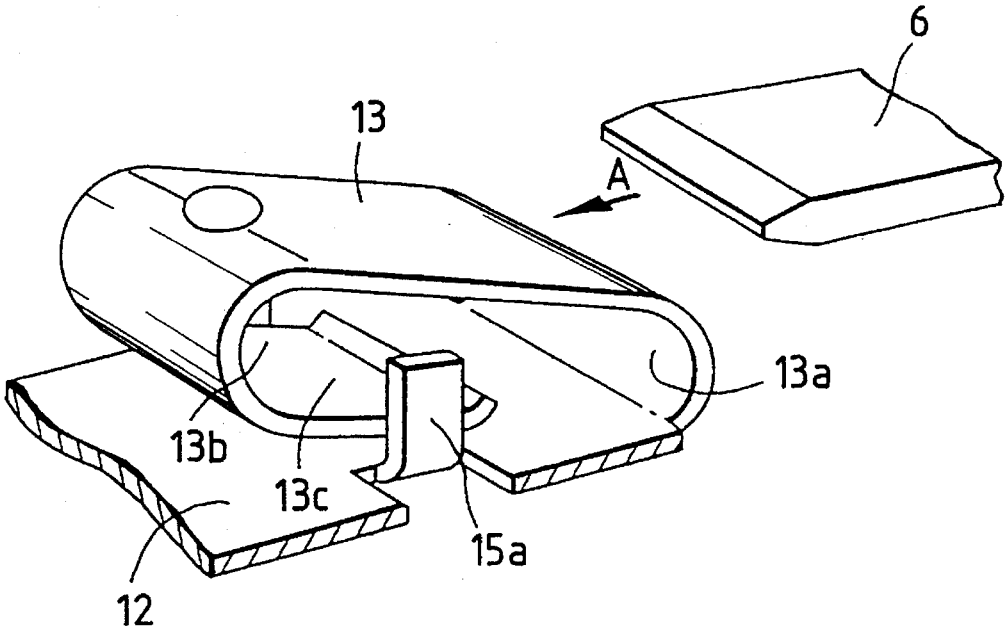
FIG. 2 is an enlarged, perspective view of an important portion of the electrical connection element.
Figure 3:
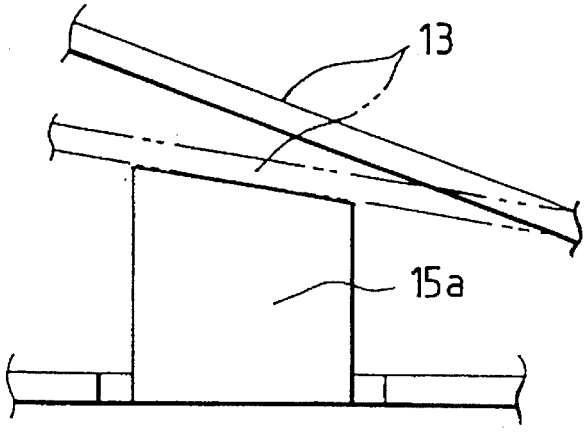
FIG. 3 is a view explanatory of the operation of a flexure prevention piece.
Figure 4:
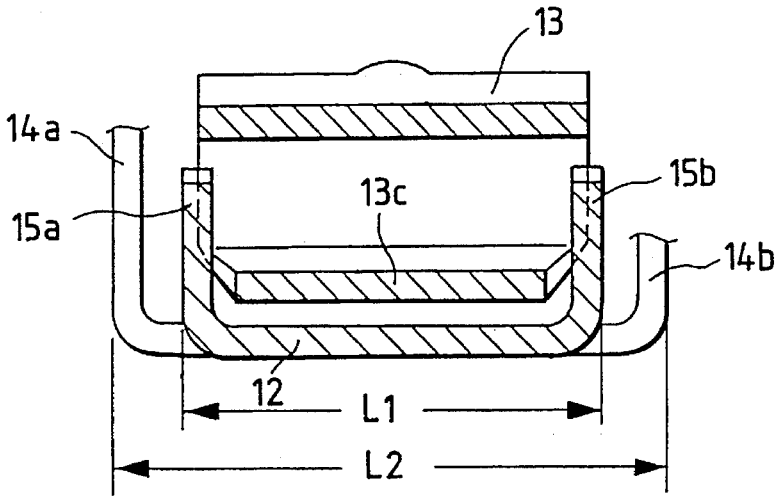
FIG. 4 is a cross-sectional view of an important portion taken along the line B—B of FIG. 1.
Figure 5:
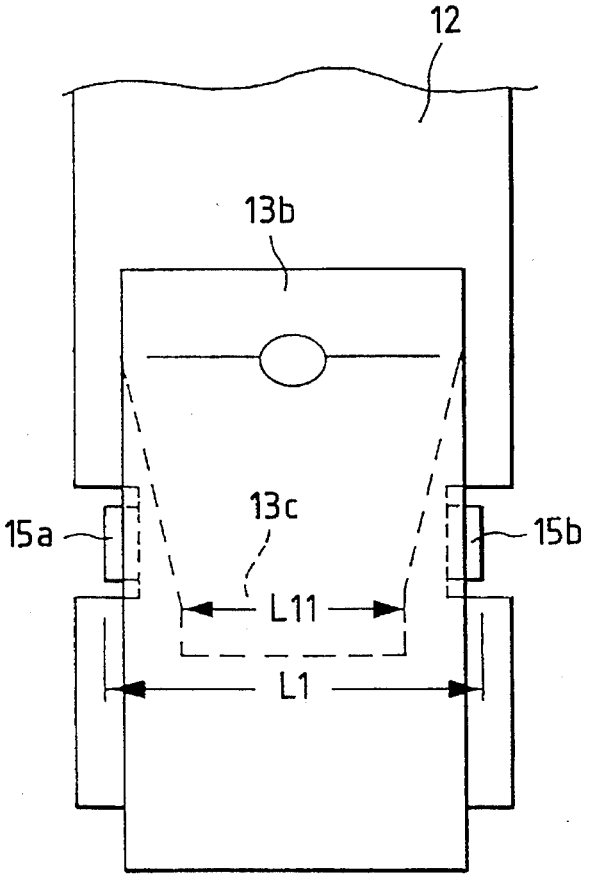
FIG. 5 is a plan view of an important portion of the electrical connection element.

FIG. 1 is a perspective view showing the construction of the preferred embodiment of the electrical connection element of the invention, FIG. 2 is an enlarged, perspective view of an important portion of the electrical connection element, FIG. 3 is an enlarged view explanatory of a flexure prevention piece, FIG. 4 is a cross-sectional view taken along the line B—B of FIG. 1, and FIG. 5 is a plan view of an important portion of the electrical connection element.

As shown in FIG. 1, the electrical connection element 11 is of an integral construction formed by blanking and bending (i.e., metal sheet working) a single metal base plate 12. More specifically, the electrical connection element 11 includes a clamping portion formed at one longitudinal end for compressively clamping an end portion of a connection wire W, a resilient connecting portion 13 formed at the other end portion by folding the metal base plate 12 twice, an outer wall portion 14 surrounding the resilient connecting portion 13, and a pair of flexure prevention pieces 15*a* and 15*b* which are formed on the metal base plate 12, and are provided respectively at opposite side walls 14*a* and 14*b* of the outer wall portion 14.

When a male terminal 6 is to be connected, it is inserted in a direction of arrow A into a terminal insertion hole formed by the resilient connection portion 13 and the outer wall portion 14.

As shown in FIG. 2, the resilient connecting portion 13 is folded back at a first folded portion 13*a* of the metal base plate 12, and is further inwardly folded back at a second folded portion 13*b* in such a manner that the length of the resilient connecting portion 13 between the first and second folded portions is sufficiently large to hold the male terminal 6 upon contact therewith. A distal end portion 13*c* is held in contact with the metal base plate 12, but this contact is not always necessary.

Figure 8:
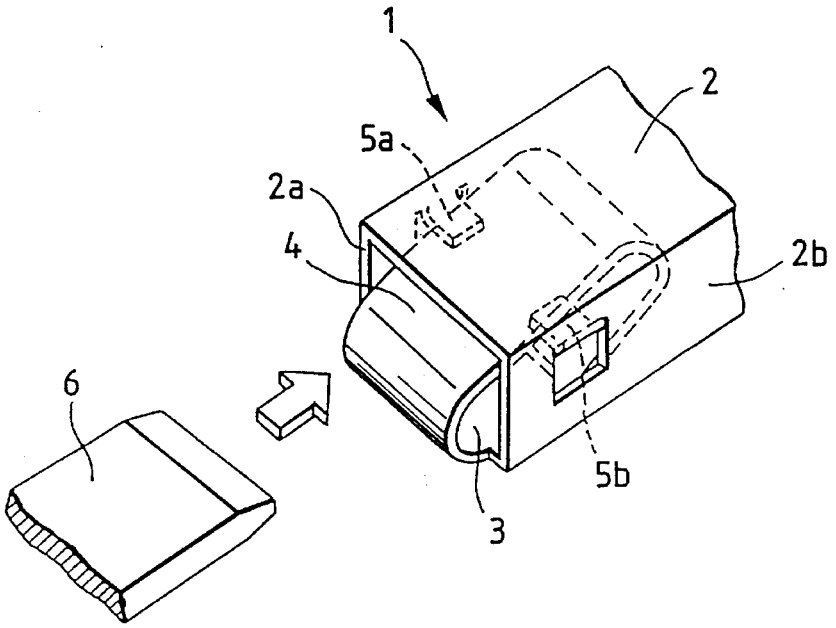
FIG. 8 PRIOR ART
FIG. 8 is a perspective view showing the construction of a conventional electrical connection element.
Figure 9:
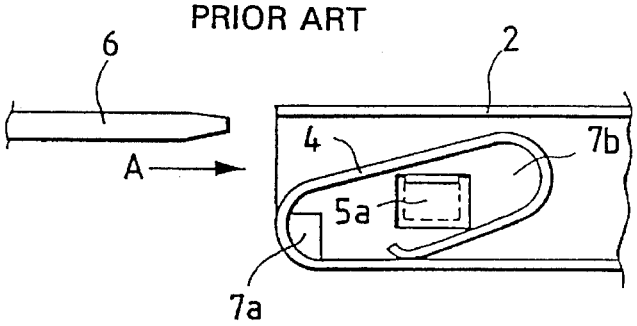
FIG. 9 PRIOR ART
FIG. 9 is a cross-sectional view of the conventional electrical connection element.
Figure 10:
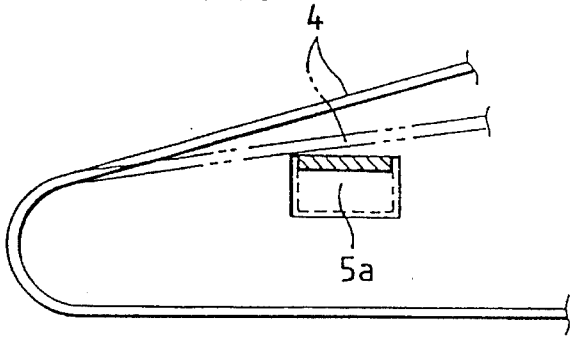
FIG. 10 PRIOR ART
FIG. 10 is a side-elevational view of the conventional electrical connection element.

The flexure prevention pieces 15*a* and 15*b* are blanked and raised to extend from the metal base plate 12 toward the back side of the resilient connecting portion 13. In the conventional construction shown in FIG. 8, the flexure prevention pieces are bent perpendicularly from the opposite side walls 2*a* and 2*b*, respectively, whereas in this embodiment the flexure prevention pieces are blanked respectively from the opposite side walls 14*a* and 14*b* with the metal base plate 12 partially cut, and then are bent perpendicularly from the metal base plate 12.

When the resilient connecting portion 13 is resiliently deformed into a position shown in phantom in FIG. 3, it is brought into engagement with the distal end of the flexure prevention piece 15*a*. In this case, the distal end is slanting at an angle corresponding to the angle of inclination of the resilient connecting portion deformed to a predetermined degree, and therefore the distal end is held in face-to-face contact with the resilient connecting portion. Therefore, even if an excessive external force is applied, the resilient connecting portion 13 will not be plastically deformed by the corners of the distal end of the flexure prevention piece 15*a*.

As shown in FIG. 4, the flexure prevention pieces 15*a* and 15*b* are disposed inwardly of the opposite side walls 14*a* and 14*b*, respectively, and are bent perpendicularly from the metal base plate. Therefore, the flexure prevention pieces 15*a* and 15*b* can be formed into a sufficiently long, desired length, and this enhances both workability and the function.

The flexure prevention pieces 15*a* and 15*b* are disposed inwardly of the opposite side walls 14*a* and 14*b*, respectively, and are bent perpendicularly at such positions that they can support the back side of the resilient connecting portion 13, and therefore the distance L between the two pieces is smaller than the distance L2 between the opposite side walls 14*a* and 14*b*. The distal end of each of the flexure prevention pieces 15*a* and 15*b* is slanting at the angle corresponding to the angle of inclination of the resilient connecting portion 13 deformed downwardly upon insertion of the male terminal 6. Therefore, when the resilient connecting portion 13 is deformed, the distal ends of the flexure prevention pieces 15*a* and 15*b* contact the back side of the resilient connecting portion 13 therealong, thereby uniformly limiting the flexing of the resilient connecting portion.

More specifically, if the male terminal 6 is inserted obliquely to thus fail to provide a proper insertion angle when the male terminal 6 is to be connected to the resilient connecting portion 13, the resilient connecting portion 13 is urged strongly, and hence intends to be deformed greatly. However, when the resilient connecting portion 13 is deformed to the position where the back side of the resilient connecting portion engages the flexure prevention pieces 15*a* and 15*b*, a further deformation of the resilient connection portion which would lead to a plastic deformation is prevented, thereby positively preventing an excessive deformation.

As shown in FIG. 5, the flexure prevention pieces 15*a* and 15*b* are formed not in the direction of the width of the resilient connecting portion 13 but in the direction of the length thereof. In other words, these prevention pieces are formed in the direction of resilient deformation of the resilient connecting portion 13. Therefore, when the resilient connecting portion 13 is urged downward by the male terminal 6, an increased area of contact of each flexure prevention piece with the back side of the resilient connecting portion is obtained, thereby reducing the flexing or deformation of the resilient connecting portion 13.

Incidentally, the distal end portion 13*c* of the resilient connecting portion 13 is tapering, and its width L11 is smaller than the distance L1 between the pair of flexure prevention pieces 15*a* and 15*b*. With this dimensional arrangement, this distal end portion will not interfere with the flexure prevention pieces 15*a* and 15*b* so that these prevention pieces 15*a* and 15*b* can be brought into contact with the back side of the resilient connecting portion 13. If such a tapering configuration is not used (in which case the width of the distal end portion 13*c* is equal to the width of the second folded portion 13*b*), this distal end portion interferes with the flexure prevention pieces 15*a* and 15*b*. Therefore, in such a case, it is necessary to bend the flexure prevention pieces 15*a* and 15*b* or to notch those portions of this distal end portion interfering with the flexure prevention pieces 15*a* and 15*b*.

Figure 6A:
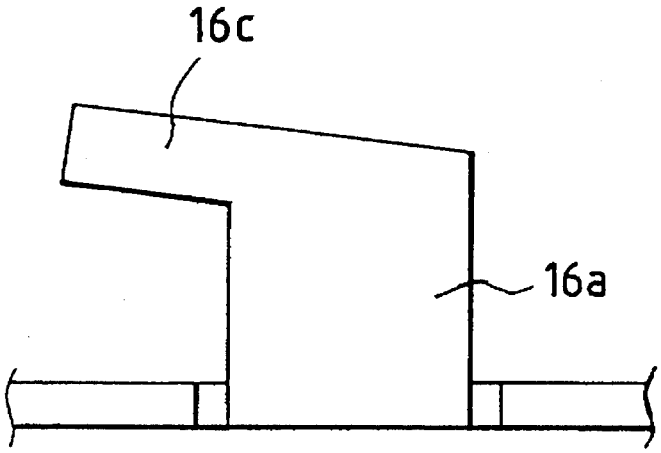
FIGS. 6 (*a*) and 6 (*b*) are side-elevational views showing modified flexure prevention pieces.
Figure 6B:
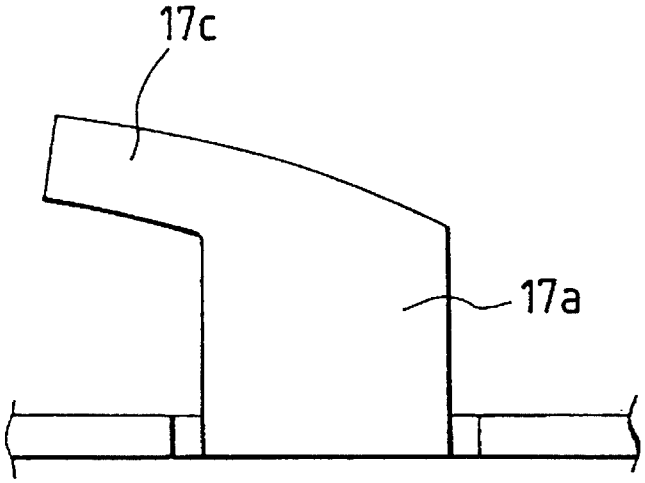

The prevent invention is not limited to the above embodiment. For example, as shown in FIG. 6 (*a*), an extension portion 16*c*, slanting at an angle corresponding to the angle of inclination of the downwardly-deformed resilient connecting portion 13, may be formed on an upper end portion of a flexure prevention piece 16*a* and extend in the longitudinal direction. With this arrangement, a further increased area of contact with the resilient connecting portion 13 is obtained as shown in FIG. 6 (*b*). If it is desired to further increase the contact area, the back side of the resilient connecting portion is formed into a curved configuration, and an extension portion 17*c* formed on an upper end portion of a flexure prevention piece 17*a* is also formed into a similar curved configuration. With this arrangement, the contact area is further increased as compared with the construction in which the flat configuration is used, and even if a larger external force is applied, the resilient connecting portion 13 will not be plastically deformed.

Figure 7:
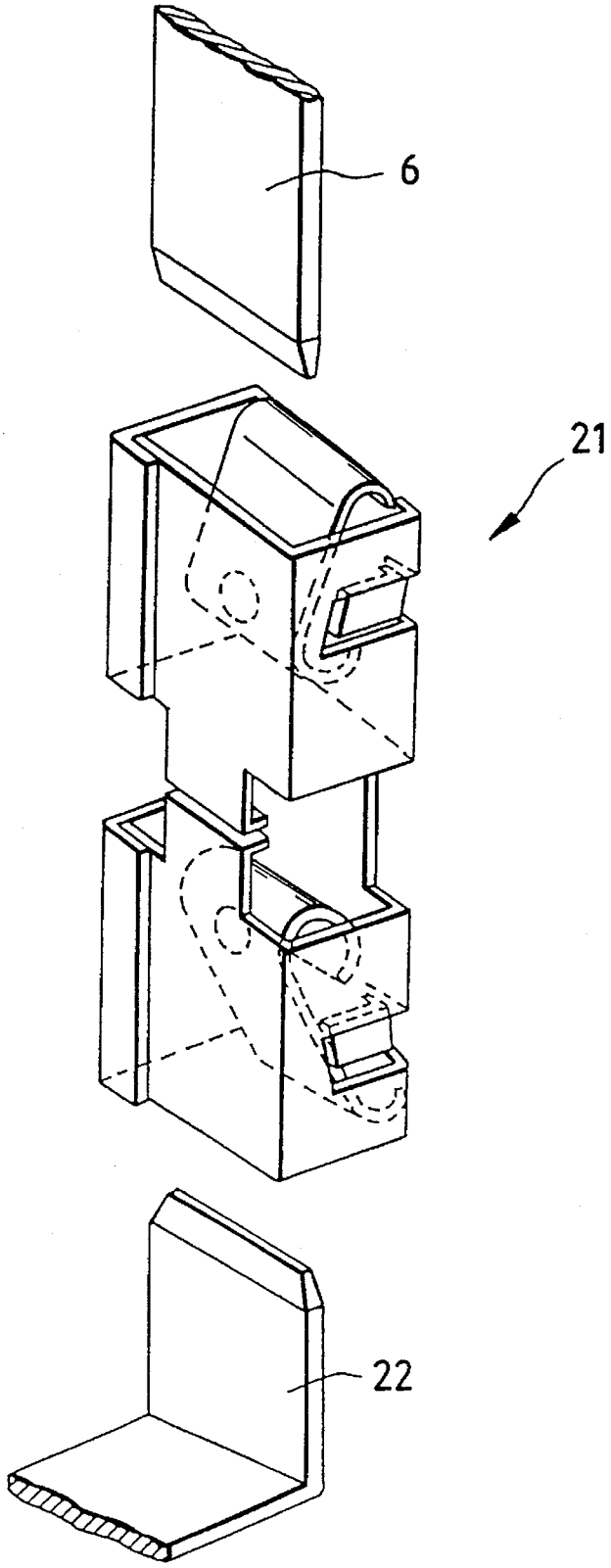
FIG. 7 is a perspective view showing an electrical connection element of the present invention used as a junction terminal.

The electrical connection element described in the above embodiment can be used not only as the female terminal of the crimp type but also as a female junction terminal 21 (FIG. 7) in which case a resilient connecting portion and flexure prevention pieces as described above are further provided at that side where the wire is connected in the above embodiment.

As described above, in the electrical connection element of the present invention, the flexure prevention pieces for preventing an excessive deformation upon contact of the male terminal are so formed as to be brought into face-to-face contact with the back side of the resilient connecting portion deformed into the predetermined configuration, and these flexure prevention pieces are projectingly formed by stamping or blanking the opposite side portions of the metal base plate.

Therefore, the resilient connecting portion will not be plastically deformed by the end edges of the flexure prevention pieces, and the flexing of the resilient connecting portion can be positively limited uniformly. Furthermore, an enhanced bending precision can be obtained more easily, thus providing an excellent workability.

What is claimed is:

1. An electrical connection element comprising:

a body member including an electrical connection portion for resiliently receiving a male terminal, said electrical connection portion having opposing top and bottom walls and including:

a resilient connection portion formed by resiliently deformably folding said bottom wall, said male terminal adapted to be resiliently received between the resilient connecting portion and said top wall; and a plurality of flexure prevention pieces for preventing an excessive deformation of the resilient connection portion, said prevention pieces extending from said bottom wall toward said resilient connecting portion such that distal ends thereof are contacted by a back side of the resilient connecting portion when the resilient connecting portion is deformed to a predetermined degree.

2. An electrical connection element as claimed in claim 1, wherein said distal ends of said flexure prevention pieces are angled at an angle corresponding to an angle of inclination of the resilient connecting portion deformed to the predetermined degree.

3. The electrical connection element of claim 1, wherein said body member includes a pair of opposing side walls which are disposed perpendicular to said top and bottom walls, and wherein said flexure prevention pieces lie in a plane which is parallel to said side walls.

4. The electrical connector of claim 1, wherein said electrical connector portion includes two of said flexure prevention pieces.

5. The electrical connector of claim 4, wherein said distal end of each of said flexure prevention pieces are planar surfaces which are contacted by said back side in a face-to-face relationship.

6. An electrical connection element comprising:

a resilient connection portion formed by resiliently deformably folding a metal base plate, a male terminal adapted to resiliently contact the resilient connecting portion;

flexure prevention pieces for preventing an excessive deformation of the resilient connection portion so as to be brought into face-to-face contact with a back side of the resilient connecting portion when the resilient connecting portion is deformed to a predetermined degree, wherein the flexure prevention pieces are protectingly formed respectively at predetermined portions of the metal base plate facing the back side of the resilient connecting portion, and a distal end of each of the flexure prevention pieces is inclined at an angle corresponding to the angle of inclination of the resilient connecting portion deformed to the predetermined degree; and wherein a distal end portion of the resilient connecting portion, folded back in facing relation to the back side thereof, is tapering to avoid the contact of the flexure prevention pieces.

7. An electrical connection element comprising:

a resilient connection portion formed by resiliently deformably folding a metal base plate, a male terminal adapted to resiliently contact the resilient connecting portion;

flexure prevention pieces for preventing an excessive deformation of the resilient connection portion so as to be brought into face-to-face contact with a back side of the resilient connecting portion when the resilient connecting portion is deformed to a predetermined degree, wherein which a distal end portion of the resilient connecting portion, folded back in facing relation to the back side thereof, is tapering to avoid contact with the flexure prevention pieces.

* * * * *